United States Patent [19]

Crosby, Jr.

[11] Patent Number: 4,671,096

[45] Date of Patent: Jun. 9, 1987

[54] ADJUSTABLE BALL MANDREL

[75] Inventor: Charlie P. Crosby, Jr., Marietta, Ga.

[73] Assignee: Lockheed Corporation, Calabasas, Calif.

[21] Appl. No.: 778,937

[22] Filed: Sep. 23, 1985

[51] Int. Cl.[4] ..... B21D 9/03

[52] U.S. Cl. ..... 72/466

[58] Field of Search ..... 72/150, 466, 480, 481, 72/478, 479, 370; 269/48.1, 48.2, 48.3, 48.4

[56] References Cited

U.S. PATENT DOCUMENTS

| | | | |
|---|---|---|---|
| 1,683,572 | 9/1928 | Mueller et al. | 72/466 |
| 2,057,359 | 10/1936 | Baker | 72/478 |
| 2,776,697 | 1/1957 | Zerlaut | 72/481 |
| 2,962,077 | 11/1960 | Condiff | 72/466 |
| 2,971,556 | 2/1961 | Armstrong et al. | 72/370 |
| 3,286,503 | 11/1966 | Garrett | 72/466 |
| 3,456,482 | 7/1969 | Maier et al. | 72/466 |
| 4,086,803 | 5/1978 | Wheeler | 72/466 |
| 4,378,689 | 4/1983 | Molz | 72/466 |

FOREIGN PATENT DOCUMENTS

| | | | |
|---|---|---|---|
| 2140338 | 11/1984 | United Kingdom | 72/466 |
| 963609 | 2/1963 | U.S.S.R. | 72/466 |

*Primary Examiner*—Lowell A. Larson

*Attorney, Agent, or Firm*—Vangelis Economou; Eric R. Katz; Stanley L. Tate

[57] ABSTRACT

A flexible ball mandrel for bending tubes which have different diameters and walls of varying thickness consisting of a series of self-lubricating balls, the diameters of which may be adjusted, and which are equally spaced apart for maintenance of a constant separation during a bend cycle connected to a shank for securing the mandrel elements properly together.

10 Claims, 9 Drawing Figures

ADJUSTABLE BALL MANDREL

TECHNICAL FIELD

This invention generally relates to the metal forming arts and in particular to apparatus for and methods of cold bending metal tubes to a desired shape. The apparatus of the present invention can be used to bend tubes of several different diameters and wall thicknesses without damaging the surface finish of such tubes.

BACKGROUND ART

Aircraft that fly today require a tubular framework to provide sufficient strength and rigidity to meet performance demands placed on such aircraft. In order to withstand the stress to which a modern aircraft is subjected, thin wall metal tubing must be bent to extreme angles without suffering damage which would weaken the tube at the point of such a bend. There are several bending methods commonly used in forming metal tubes into desired shapes. The most common of these bending methods are draw bending, compression bending, roll bending, and stretch bending. In draw bending, a workpiece is clamped against a bending form which rotates, drawing the workpiece through a pressure die, and if needed, over a mandrel. This method is very versatile and offers good control of metal flow for small radius and thin wall tube bending.

In compression bending a workpiece is wrapped around a stationary bending form by a moving wiper shoe. This method is desirable for bending rolled or extruded sections but metal flow is not as well controlled as in draw bending and is not practical for mandrel bends when there is more than one bend in the piece.

Roll bending is commonly used to bending round coils which are sometimes cut and the ends joined to form rings. This is impractical when there is more than one bend in a workpiece and is usually limited to heavy-walled tubing and large radii over six times the tube diameter. With this method, control of spring back and angles is difficult.

In stretch bending an entire workpiece is stretched longitudinally beyond its elastic limits and then wrapped around a form. This method reduces spring back, but is usually much slower than draw bending, compression bending and roll bending. This method is primarily used to form large irregular curves in sections that do not require mandrels.

Draw bending is commonly used to form tubes for the aircraft industry because the tubing used is generally thin-walled and the bends are generally small radius bends. A mandrel having a ball and socket linkage between ball shaped segments is commonly used in this process because balls can be added or removed easily; balls are also free to rotate and thereby distribute wear, and balls will flex in any plane thereby accommodating compound bends. While ball mandrels of this type have many good characteristics, such mandrels are expensive and are limited to specific tube diameters and wall thicknesses and because such mandrels are made of metal they are capable of damaging anti-corrosion coatings on the workpiece as a bend is being made.

DISCLOSURE OF THE INVENTION

Accordingly, it is an object of the present invention to provide a ball mandrel capable of use with tubes having several diamters and several wall thicknesses.

Another object of the present invention is to provide a ball mandrel which will not damage anti-corrosion coatings present on the inner wall of a tube being bent.

It is a further object of the present invention to reduce the tooling cost associated with tube bending in the aircraft industry.

A principal feature of the present invention is the provision of a unique ball mandrel for use in bending tubes, each element of which has variable diameter, such bending now being accomplished using mandrels having constant diameters. In accordance with the present invention, a mandrel is provided one end of which is a cylindrical shank having a central bore which shank is pivotally attached on one end to a series of ball elements. Each ball element has a discrete pivot point in relation to adjacent ball elements along a common centerline and each ball element being separated from adjacent ball elements by a means for fixing a minimum allowable distance between the ball elements. Additionally, each ball element includes means for varying the circumferential dimension of the element in a plane perpendicular to the common centerbore. The mandrel further includes a means for joining the shank and ball elements along the common centerline.

Another feature of the present invention is the capability of the mandrel to accommodate spacers of various thicknesses between the ball elements thereby varying the pivot point of each ball element along the centerline common to all ball elements and the shank. In accordance with one embodiment of the present invention the spacer elements positioned between the ball elements have diameters less than the diameter of the ball element and the spacer elements having their greatest cross-sectional dimension along a line coincident with the center line of the mandrel. The smallest cross-sectional dimensions of the spacer elements occur along its periphery. The spacer elements also include a central passageway, the center line of which coincides with the centerline of the mandrel itself.

Another feature of the present invention is the fabrication of the mandrel from a synthetic material which is substantially non-abrasive material having good self-lubricating qualities and being substantially resistant to deformation.

Another important feature of the present invention is the capability of the mandrel ball elements to permit variation of element diameter within certain limits. In the principal embodiment of the present invention the ball elements comprise disks which have a predetermined thickness and an accurate circumferential surface and further each disk having a central bore lined with a bushing and at least four symmetrical cuts radiating from the central bore to the circumferential surface of the disk and means within each segment defined by the four symmetrical cuts to independently vary the apparent diameter of the disk within the segments.

A principal advantage of the present invention is the ability of the present ball mandrel to be used to bend tubes which have different diameters and different wall thicknesses.

Another advantage of the present invention is the low procurement cost of mandrels fabricated in accordance with the present invention.

Still another advantage of the present invention is the reduced downtime associated with bending operations using the present mandrel; this reduced downtime resulting from the elimination of time-consuming alignment procedures associated with prior art ball mandrels.

These and other objects, features, and advantages of the present invention will become more readily apparent with a reading of the following more detailed description of the preferred embodiment in conjunction with the accompanying drawings and claims. The drawings in which like reference characters indicate corresponding parts in all views are not necessarily to scale, emphasis instead being placed on illustrating the principles of the invention.

BEST MODE OF CARRYING OUT THE INVENTION

Figure 1:
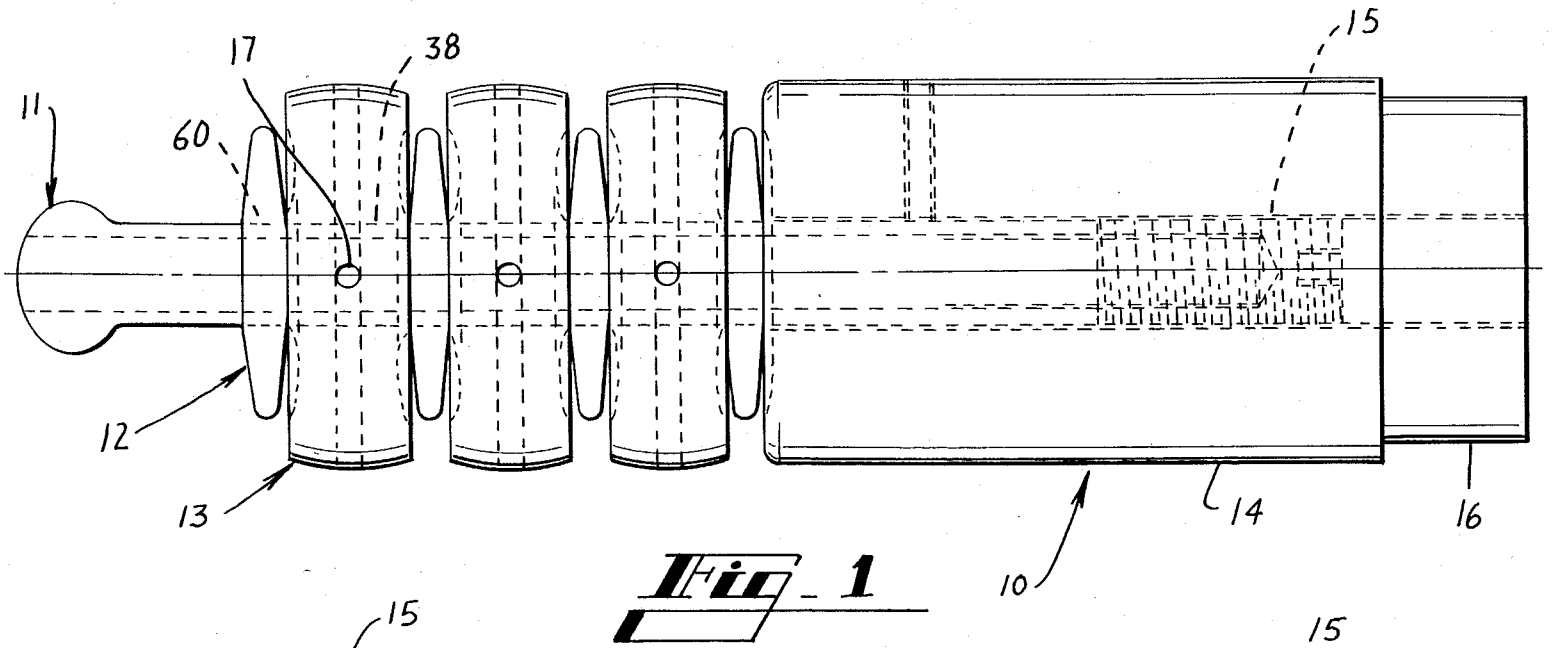
FIG. 1 is a partial cross-sectional view of an assembled ball mandrel.
Figure 2A:
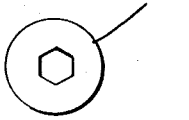
FIG. 2*a* is an end view of the shank end cable termination.
Figure 2:
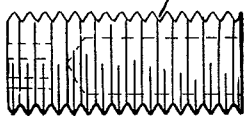
FIG. 2 is a side view of the shank end cable termination.

Referring now to FIG. 1, the ball mandrel 10 of the present invention is shown assembled. Ball mandrel 10 comprises ball end cable termination 11, spacer 12, ball element 13, shank 14 and shank end termination 15. Ball elements 13 are threaded onto a flexible central cable member 18 and connected to shank 14 which installs into a tube bending machine (not shown). Ball elements 13 are spaced apart by spacer disks 12 so that the proper spatial relationship is always maintained between ball elements 13 during a bending cycle because failure to maintain proper ball spacing can cause irregular deformation of a tube during bending. During bending, the ball elements 13 are held inside a tube by the tube bending machine so that the inner wall of the tube being bent contacts the curbed outer surface of mandrel 13. As the tube is forced around the bending die the ball elements and spacers flex inside the tube and prevent the tube wall from deforming inward by providing a source of resistance for the tube wall to be drawn around. The ball elements 13 and spacers 12 are best fabricated from an engineering plastic such as ultra high molecular weight polyurethane that has good self-lubricating qualities and is highly deformation resistant so that adequate pressure is kept on the tube inner wall and to prevent scratching or other damage to any coating which might be present on the tube wall.

Figure 3:
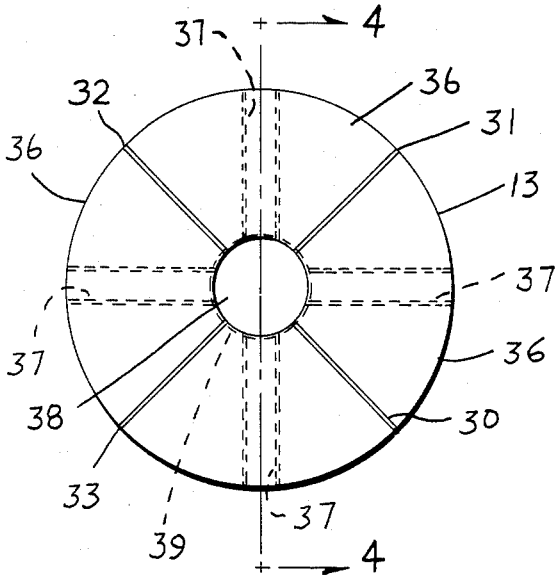
FIG. 3 is an end view of a ball element from the ball mandrel of the present invention.
Figure 4:
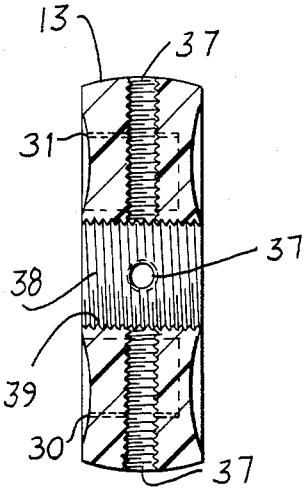
FIG. 4 is a partial cross-section of a ball element of the ball mandrel of the present invention, including optional threads 39 along the bore of the central passageway.

Referring now to FIGS. 3 and 4; ball elements 13 are adapted to expand or contract thereby increasing their effective diameter. This is accomplished by four segmenting cuts 30, 31, 32 and 33, which are equally spaced around the circumference of ball 13, these cuts extending radially through the outer surface of the ball element and extending into a depth approximately 60% of the width dimension of the ball element body as measured in the direction parallel to the flexible central cable member 18. Centered in each segment is a threaded expander screw 37, which, when threaded into the ball 13, presses against central bushing 35 and forces the outer segment 36 of the ball outward from its center, thereby increasing the ball diameter. An even expansion of ball diameter can be accomplished by adjusting the screw 37 in each segment 36 of the ball 13. Bushing 35 is generally fabricated from brass or similar soft metallic material. If it is desired to reduce the diameter of ball 13, this is accomplished by reversing the direction in which screw 37 is turned.

Figure 5:
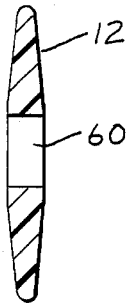
FIG. 5 is a cross-sectional view of a ball spacer used in the ball mandrel of the present invention.
Figure 6:
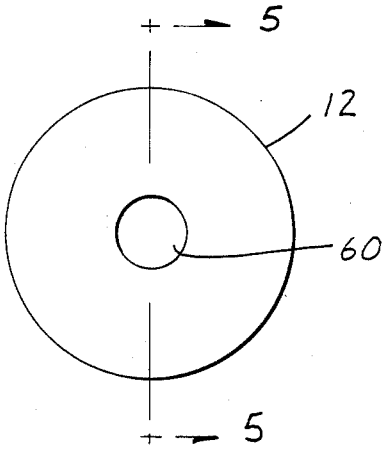
FIG. 6 is a front view of a ball spacer used in the ball mandrel of the present invention.
Figure 7:
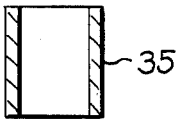
FIG. 7 is a cross-sectional view of the ball bushing used in a ball element from the present invention.
Figure 8:
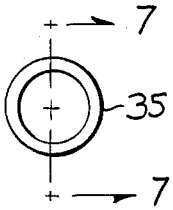
FIG. 8 is an end view of the ball-bushing used in a ball element from the present invention.

FIGS. 5 and 6 illustrate the nature of spacer 12, specifically showing the general shape of the spacer and cable passage 60. FIGS. 7 and 8 show the general nature of bushing 35 which lines cable passage 38 of the ball elements 13 and serves to protect the cable passage 38 from abrasive wear caused by movement of the ball 13 on the flexible central cable member 18 which binds it to shank 14 as the mandrel flexes during a bending cycle.

Bushing 25 may be threaded along the outside diameter so as to remain in continual contact with the optional threads along the bore of the central passageway 39 of the ball element 13.

The length of the mandrel 10 is adjustable by a rotation of the shank 14 about the central flexible cable member 18 and the shank end termination 15, both elements sharing a common centerline with the mandrel 10.

Flats 16 on shank 14 are provided as wrenching surfaces so that adjustment of mandrel length can be easily accomplished while the mandrel 10 is in place in a bending machine.

Although the present invention has been discussed and described with primary emphasis on one embodiment, it should be obvious that adaptations and modifications can be made thereto without departing from the spirit and scope of the invention.

What is claimed is:

1. A flexible ball mandrel for bending tubes which have various diameters and wall thicknesses comprising:

a cylindrical shank having a central bore, said shank being pivotally attached on one end to a series of ball elements, each of said ball elements having a central bore, an outer surface having a discrete number of segments, and a discrete pivot point within said central bore and along a known common centerline in relation to adjacent ball elements and each ball being separated from adjacent ball elements by a spacer means having a central passageway and for fixing a minimum allowable distance between said ball elements;

means for varying the circumferential dimension of said ball elements in a plane perpendicular to said known common centerline comprising threaded members equally spaced around the circumference of each of said ball elements and symmetrically located in each segment of said outer surface and extending through said segments to a metallic bushing within the central bore of said ball element and adapted to expand or contract said ball element by threading said members into and out of threaded bores intersecting said metallic bushing at an angle perpendicular to the centerline of said ball element; and means extending through said central bores and passageways for joining said spacer means and said ball elements along said known common centerline.

2. The mandrel of claim 1, further comprising means for adjusting the length of said mandrel and varying the distance between said ball elements.

3. The mandrel of claim 2, wherein the means for adjusting the length of said mandrel and varying the distance between said ball elements comprises a flexible cable passing through the central bores and central passageways respectively of said ball elements and said spacer elements and permanently fixed on one end to a cable termination means and on the other end to a threaded member adapted to be threaded into and out of the central bore of said shank.

4. The mandrel of claim 1, wherein said spacer means for fixing the minimum allowable distance between said ball elements comprises a spacer element having a diameter less than the diameter of the ball element, said spacer element having its greatest cross-sectional width dimension, as measured along a line parallel to said known common centerline, along a line coincident with the centerline of the mandrel and its smallest cross-sectional dimension along its periphery and having a central passageway, the centerline of which coincides with the centerline of the mandrel.

5. The mandrel of claim 1, wherein said ball elements each comprise a wheel shaped ball element having a partially segmented curved outer surface, a metallic bushing lining said central passageway of said ball element and means for varying the apparent diameter of said ball element.

6. The mandrel of claim 5, wherein said partially segmented curved outer surface further comprises four radial cuts extending partially through said axial length of the body of said ball element from a peripheral edge of said ball element, said edge being farthest from said bore of said ball element, to said metallic bushing.

7. The mandrel of claim 6, wherein said four radial cuts extend partially through the body of said ball element to a depth of about 60 percent of the dimension of said body measured in a direction parallel to said centerline.

8. The mandrel of claim 5, wherein said metallic bushing and said central bore of said ball element each further comprise screw threads for threadably joining said metallic bushing and said ball element.

9. The mandrel of claim 1, wherein the pivot point of each of said ball elements coincides with the intersection of the centerline of said mandrel and a line perpendicular to said mandrel center line and the center line of said means for varying the apparent diameter of each said element.

10. The mandrel of claim 6, wherein said means for varying the diameter of said ball element comprises threaded bores symmetrically spaced around the circumference of said ball element and centrally located between said radial cuts and extending radially through said ball element to said bushing means and adapted to expand or contract the diameter of said ball element as threaded members are threaded into and out of said threaded bores whereby pressure is alternatively applied to or removed from said bushing means.

* * * * *